US010050417B2

(12) United States Patent
Akiyoshi et al.

(10) Patent No.: US 10,050,417 B2
(45) Date of Patent: Aug. 14, 2018

(54) SPARK PLUG AND MANUFACTURING METHOD THEREOF

(71) Applicant: DENSO CORPORATION, Kariya, Aichi-pref. (JP)

(72) Inventors: Ryohei Akiyoshi, Kariya (JP); Ken Hanashi, Kariya (JP); Tomoyuki Watanabe, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/692,254

(22) Filed: Aug. 31, 2017

(65) Prior Publication Data

US 2018/0062357 A1 Mar. 1, 2018

(30) Foreign Application Priority Data

Aug. 31, 2016 (JP) ..... 2016-169757

(51) Int. Cl.

| | |
|---|---|
| ***H01T 13/20*** | (2006.01) |
| ***H01T 13/32*** | (2006.01) |
| ***H01T 13/02*** | (2006.01) |
| ***H01T 13/34*** | (2006.01) |
| ***H01T 13/08*** | (2006.01) |
| ***H01T 21/02*** | (2006.01) |

(52) U.S. Cl.

CPC ..... *H01T 13/34* (2013.01); *H01T 13/08* (2013.01); *H01T 13/32* (2013.01); *H01T 21/02* (2013.01)

(58) Field of Classification Search

CPC ..... H01T 13/32; H01T 13/34; H01T 13/20; H01T 13/08; H01T 21/00; H01T 21/02

See application file for complete search history.

(56) References Cited

U.S. PATENT DOCUMENTS

| | | | | |
|---|---|---|---|---|
| 6,166,480 | A | 12/2000 | Ishida et al. | |
| 8,253,313 | B2 * | 8/2012 | Inoue | H01T 21/02 313/141 |
| 2001/0029916 | A1 | 10/2001 | Kanao | |
| 2002/0038992 | A1 | 4/2002 | Morita et al. | |
| 2002/0067111 | A1 | 6/2002 | Shibata et al. | |
| 2002/0108606 | A1 | 8/2002 | Miwa et al. | |
| 2003/0193282 | A1 | 10/2003 | Shibata et al. | |
| 2004/0061421 | A1 | 4/2004 | Morita et al. | |

(Continued)

FOREIGN PATENT DOCUMENTS

| | | |
|---|---|---|
| JP | 2002-324650 | 11/2002 |
| JP | 2008-294006 | 12/2008 |

(Continued)

*Primary Examiner* — Mariceli Santiago

(74) *Attorney, Agent, or Firm* — Nixon & Vanderhye P.C.

(57) ABSTRACT

Disclosed herein is a spark plug capable of suppressing electrode consumption caused by a spark discharge and a method of manufacturing the same. A section except a welded section formed by welding a tip surface of a center electrode is defined as an unwelded section in side surfaces of a center chip, and a length of the unwelded section along a center axis of the center chip is defined as an unwelded section length. Under this definition, the welded section is formed in order for an unwelded section length in a side surface opposite to an inclination direction side of the center chip in the center chip to become longer than an unwelded section length in a side surface of the inclination direction side of the center chip in the center chip.

7 Claims, 12 Drawing Sheets

(56) References Cited

U.S. PATENT DOCUMENTS

| | | | | |
|---|---|---|---|---|
| 2005/0016485 | A1 | 1/2005 | Miwa et al. | |
| 2005/0264151 | A1 | 12/2005 | Mori et al. | |
| 2007/0080618 | A1 | 4/2007 | Torii et al. | |
| 2012/0001533 | A1* | 1/2012 | Sakayanagi | H01T 13/20 313/141 |
| 2012/0025691 | A1* | 2/2012 | Sakayanagi | H01T 13/20 313/141 |
| 2012/0062099 | A1* | 3/2012 | Miyashita | B23K 26/28 313/144 |
| 2012/0252298 | A1 | 10/2012 | Hori et al. | |
| 2013/0099652 | A1 | 4/2013 | Below et al. | |
| 2013/0328476 | A1 | 12/2013 | Ban et al. | |
| 2018/0062356 | A1* | 3/2018 | Hanashi | H01T 13/32 |

FOREIGN PATENT DOCUMENTS

| | | |
|---|---|---|
| JP | 2012-89353 | 5/2012 |
| JP | 2012-256590 | 12/2012 |

* cited by examiner

SPARK PLUG AND MANUFACTURING METHOD THEREOF

CROSS-REFERENCE TO RELATED APPLICATION

This application is based on and claims the benefit of priorities from earlier Japanese Patent Application No. 2016-169757 filed Aug. 31, 2016, the descriptions of which are incorporated herein by reference.

BACKGROUND

Technical Field

The present invention relates to a spark plug for an internal-combustion engine and a manufacturing method thereof, and in particular, to a the spark plug including a center electrode with a center electrode side chip and a ground electrode with a ground electrode side chip, wherein both the center electrode side chip and the ground electrode side chip are disposed to be parallel to each other but inclined to a center axis of the spark plug.

Background Art

A spark plug configured to perform ignition at a fuel-air mixture inside a combustion chamber is provided in an Internal-combustion engine. The spark plug generates a spark discharge between two electrodes spaced apart from each other, thereby performing the ignition in the fuel-air mixture.

Various technologies have been disclosed in the past pertaining to an electrode shape of the spark plug and an arrangement thereof. For example, the spark plug disclosed in Patent Document 1 is provided with a center electrode in which a center electrode side chip is provided and a ground electrode in which a ground electrode side chip is provided. The center electrode is held at an internal side of a mounting bracket, and the ground electrode is provided at a tip of the mounting bracket. The spark plug generates the spark discharge between a tip surface of the center electrode side chip and a tip surface of the ground electrode side chip.

In the case of the aforementioned spark plug, a section of the ground electrode, where the ground electrode side chip is provided, is inclined to a center axis of the mounting bracket. Accordingly, a direction in which the ground electrode side chip faces toward the center electrode chip is configured to become a direction inclined to the center axis of the center electrode. Furthermore, the ground electrode side chip is extended along a same direction from a side surface of the ground electrode.

In comparison with a configuration in which the ground electrode is extended until a position right above the center electrode, that is to say a position with which the center axis of the center electrode is overlapped, a space between the ground electrode and the center electrode is widely ensured in the above-mentioned configuration.

Accordingly, a phenomenon in which a flame kernel generated in the vicinity of the center electrode contacts a surface of the ground electrode and the growth of the flame kernel is impeded is able to be prevented such that satisfactory ignitability is able to be implemented. Furthermore, the ground electrode is shortened according to the aforementioned configuration, and thus consequently heat dissipation of the ground electrode is able to be satisfactorily obtained.

Additionally, in the below Patent Document 1, the tip surface of the center electrode side chip and the tip surface of the ground electrode side chip are disposed to be opposite to each other in a mutually parallel state by inclining the center electrode side chip provided at a tip of the center electrode.

RELATED ART DOCUMENTS

Patent Document

[Patent Document 1] Patent Application Publication No. 2002-324650

The above information disclosed in this Background section is only to enhance the understanding of the background of the disclosure and therefore it may contain information that does not form the prior art that is already known to a person of ordinary skill in the art.

A spark plug provided with an inclined ground electrode as disclosed in the Patent Document 1 is configured for a portion of an air flow of a combustion chamber to easily flow along an inclined section of the ground electrode. A spark discharge route generated between electrodes of the spark plug has a tendency to become a route expanding with a circular arc shape towards a direction apart from the ground electrode due to an influence of the air flow. Consequently, for example, a starting point of a spark discharge may move to a welded section between a center electrode and a chip thereof, thereby have a possibility that the welded section may be consumed in a short period.

SUMMARY

The present disclosure has been designed in consideration of the drawbacks described above. An objective of the present disclosure is to provide a spark plug capable of suppressing electrode consumption caused by a spark discharge and a method of manufacturing the same.

An exemplary embodiment of the present disclosure has been made in an effort to provide a spark plug for an internal-combustion engine, including: a cylindrical mounting bracket; a ground electrode configured for one end side to be fixed to the mounting bracket, and configured for at least a portion of the other end side to be inclined to a center axis of the mounting bracket in order to come close to the center axis thereof as moving to the other end side; a ground chip provided to protrude from a portion of the ground electrode; a center electrode configured to be disposed along the center axis of the mounting bracket, and configured for a normal line of a surface to be welded, which is an end surface of the center electrode, to be inclined toward a side of the ground electrode; and a center chip configured to be welded on the surface to be welded in a state where a center axis of the center chip is perpendicular to the surface to be welded, and configured to be provided in a state where the center chip is inclined to a center axis of the center electrode, wherein when a section except a welded section formed by welding the surface to be welded is defined as an unwelded section in side surfaces of the center chip, and a length of an unwelded section along the center axis of the center chip is defined as an unwelded section length, the welded section is formed in order for an unwelded section length in a side surface opposite to an inclination direction side of the center chip in the center chip to become longer than an unwelded section length in a side surface of the inclination direction side of the center chip in the center chip.

In the spark plug based on the aforementioned configuration, the side surface opposite to the inclination direction side of the center chip in the center chip, that is to say an unwelded section length in a section opposite to a side where the ground electrode exists is configured to become longer than an unwelded section length in a side where the ground electrode exists. That is, in a section which easily become a starting point of the spark discharge which becomes a circular arc shape due to an influence of an air flow, the unwelded section length is configured to become long in comparison with other sections. Consequently, since a probability of the starting point of the spark discharge moving to a welded section, which is comparatively easy to be consumed, becomes low, the electrode consumption caused by the spark discharge is suppressed.

Another embodiment of the present disclosure provides a method of manufacturing the spark plug based on the above-mentioned configuration, including: A) a preparation process of preparing the center electrode and the center chip respectively; B) an installation process of installing the center chip on the surface to be welded in order for the center axis of the center chip to be perpendicular to the surface to be welded; and C) a welding process of irradiating a laser between the center chip and the surface to be welded, and to weld the center chip onto the surface to be welded. In the welding process, for example, laser irradiation intensity may be changed depending on sections such that distributions of the unwelded section lengths in the side surfaces of the center chip may be appropriately configured as described above.

According to embodiments of the present disclosure, an objective of the present disclosure is to provide a spark plug capable of suppressing electrode consumption caused by a spark discharge and a method of manufacturing the same.

DESCRIPTION OF THE PREFERRED EMBODIMENTS

Figure 1:
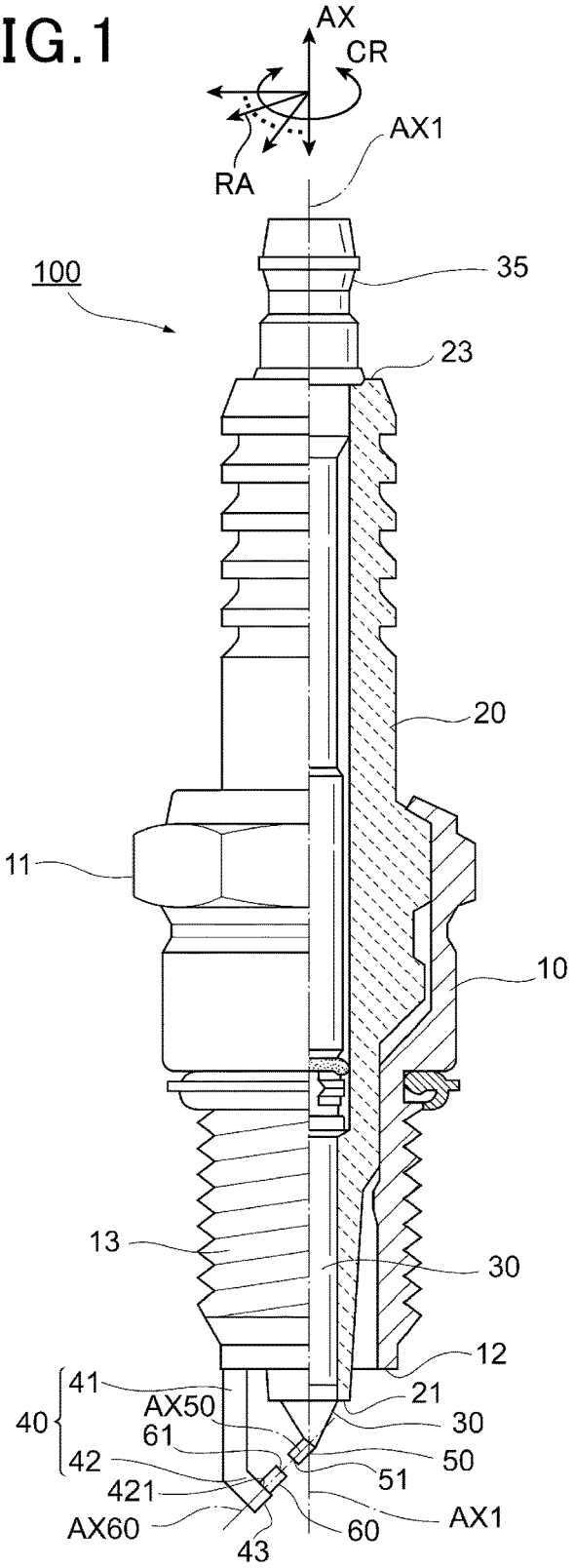
FIG. 1 is a partial cross-sectional drawing illustrating an overall configuration of a spark plug according to an exemplary embodiment of the present disclosure.

Specifically structural or functional description with respect to exemplary embodiments of the present disclosure disclosed in the specification is illustrated only for the purpose of describing the exemplary embodiments of the present disclosure, and the exemplary embodiments of the present disclosure may be modified in various different ways, all without departing from the spirit or scope of the present disclosure.

As the exemplary embodiments of the present disclosure may be modified in various different ways and may have various modifications, the exemplary embodiments is illustrated on the drawings and is described in detail in the specification However, the exemplary embodiments of the present disclosure should not be limited to the specifically disclosed forms, and are intended to cover various modifications and equivalent arrangements, or substitutes included within the spirit and technology scope of the present disclosure.

The terms used in the specification are only used to describe the specific exemplary embodiments and are not intended to limit the present disclosure.

As used herein, the singular expressions "a", "an" and "the" are intended to include the plural expressions as well, unless the context clearly indicates otherwise.

An exemplary embodiment of the present disclosure will be described more fully hereinafter with reference to the accompanying drawings, in which a plurality of exemplary embodiments of the disclosure are depicted. With respect to the same components in respective drawings, the same symbols are used and duplicated descriptions thereof are omitted for better understanding and ease of description.

A configuration of a spark plug 100 according to an exemplary embodiment is described with reference to FIG. 1. The spark plug 100 is a device configured to generate a spark discharge in a combustion chamber of an internal-combustion engine (not depicted) such that ignition of a fuel-air mixture inside the combustion chamber is performed. The spark plug 100 is provided with a mounting bracket 10, an insulator 20, a center electrode 30, and a ground electrode 40.

In the embodiment, as shown in FIG. 1, the mounting bracket 10 has a center axis AX1, so that an axis direction AX can be defined as a direction which is in line with the center axis AX1. Further, a circumferential direction CR can be defined as directions going around the center axis AX1, while a radial direction RA can be defined as directions radially and outwardly expanding from the center axis AX1.

The mounting bracket 10 is a portion mounted into the internal-combustion engine. The mounting bracket 10 is entirely formed with a cylindrical shape, and holds the insulator 20 and the center electrode 30 (to be described later) therein. A male screw 13 and a hexagonal nut 11 are formed in an outer surface side of the mounting bracket 10. The male screw 13 is inserted into a screw hole (a hole machined as a female screw) formed in a wall of the internal-combustion engine and fixed thereinto. When the spark plug 100 is mounted into the internal-combustion engine, a worker rotates the hexagonal nut 11 by using a torque wrench and other tools, thereby tightening and fixing the spark plug 100 into the screw hole. When the spark plug 100 is mounted into the internal-combustion engine, the center electrode 30 and the ground electrode 40 become disposed at an inside of the combustion chamber of the internal-combustion engine.

The insulator 20 is a member to ensure insulation between the mounting bracket 10 and the center electrode 30. The insulator 20 is formed of alumina ceramic in the exemplary embodiment. The insulator 20 is entirely formed with a cylindrical shape and holds the center electrode 30 at an inside thereof. The insulator 20 is fixed onto an inner surface of the mounting bracket 10 in a state where a center axis of the insulator 20 is coincident with a center axis AX1 of the mounting bracket 10. An end portion 21 of a combustion chamber side in the insulator 20 further protrudes from an end portion 12 of the mounting bracket 10 in an outside direction (a downward direction in FIG. 1). Furthermore, an end portion 23 opposite to the combustion chamber in the insulator 20 also protrudes from the mounting bracket 10 in an outside direction (an upward direction in FIG. 1).

A portion of a terminal 35, which is provided to apply a voltage to the center electrode 30, is accommodated at the inside of insulator 20. The other portion of the terminal 35 further protrudes from the end portion 23 of the insulator 20 in an outside direction. Conduction between the terminal 35 and the center electrode 30 is performed through a resistor.

The center electrode 30 is an approximately cylindrical-shaped member formed of a nickel-base alloy based on a nickel as a principal component. The center electrode 30 is fixed onto an inner surface of the insulator 20 in a state where a center axis of the center electrode 30 is coincident with the center axis AX1 of the mounting bracket 10. That is, the center electrode 30 is disposed along the center axis AX1 of the mounting bracket 10. An end portion of the combustion chamber side in the center electrode 35 further protrudes from the end portion 21 of the insulator 20 in an outside direction (a downward direction in FIG. 1). As depicted in FIG. 1, a shape of a section protruding from the end portion 21 in the center electrode 30 becomes a taper shape in which a diameter becomes small as moving to a tip side. The center electrode 30 is held in a state where the center electrode 30 is electrically insulated from the mounting bracket 10.

A tip of the section protruding from the end portion 21 in the center electrode 30, that is to say a tip of the combustion chamber side is provided with a center chip 50. The center chip 50 together with a ground chip 60 (to be described later) is a section which becomes a starting point of a spark discharge, and is provided to protrude from the tip of the center electrode 30. The center chip 50 according to the exemplary embodiment is a member formed of a noble metal alloy based on platinum as a base material, and a shape thereof becomes a cylindrical-shape. A noble metal alloy based on iridium as a base material may be used as a material of the center chip 50. A detailed shape of the center chip 50 will be described later.

The ground electrode 40 is a member formed of the nickel-base alloy based on nickel as the principal component. A shape of the electrode 40 becomes an approximately prism shape. One end of the ground electrode 40 is welded onto the end portion 12 of the combustion chamber side in the mounting bracket 10 and is fixed thereonto. As depicted in FIG. 1, a section, onto which the ground electrode 40 is fixed in the end portion 12 of the mounting bracket 10, is positioned to be spaced apart from the center axis AX1 of the mounting bracket 10. A tip 43 opposite to the above-mentioned section in the ground electrode 40 protrudes toward the combustion chamber side.

In the case of a section adjacent to the end portion 12 in the ground electrode 40, that is to say a section labelled with 41 in FIG. 1, a center axis of the section almost becomes parallel to the center axis AX1 of the mounting bracket 10. Furthermore, in the case of a section of a side of the tip 43 in the ground electrode 40, that is to say a section labelled with 42 in FIG. 1, a center axis of the section is inclined to the center axis AX1 of the mounting bracket 10. More specifically, the section is inclined to come close to the center axis AX1 of the mounting bracket 10 as moving to the side of the tip 43. However, when viewed along the center axis AX1, the ground electrode 40 and the center axis AX1 are not overlapped with each other.

The ground chip 60 is provided at a position adjacent to the tip 43 in the ground electrode 40. The ground chip 60 in the exemplary embodiment is a member formed of the noble metal alloy based on platinum as the base material, and a shape thereof becomes a cylindrical-shape. A noble metal alloy based on iridium as the base material may be also used as a material of the ground chip 60.

A portion of the ground chip 60 is welded onto a side surface 421 of a side of the center axis AX1 in the ground electrode 40 and is fixed thereonto. A center axis AX60 of the ground chip 60 is overlapped with the side surface 421. Consequently, the ground chip 60 protrudes from a portion of the ground electrode 40 in a direction toward a side of the center chip 50. Furthermore, the center AX60 of the ground chip 60 is inclined to the center axis AX1 of the mounting bracket 10. A tip surface 61 of the ground chip 60 is perpendicular to the center axis AX60 and faces a tip surface 51 (to be described later), which is opposite to the tip surface 61 thereof, of the center chip 50.

The center chip 50 and the ground chip 60 are spaced apart from each other, and a gap (which is also referred to as a "spark gap") where the spark discharge is generated is formed therebetween. A high voltage between the mounting bracket 10 and the terminal 35 is applied during the operation of the internal-combustion engine such that the spark discharge is generated between the center chip 50 and the ground chip 60.

Figure 2:
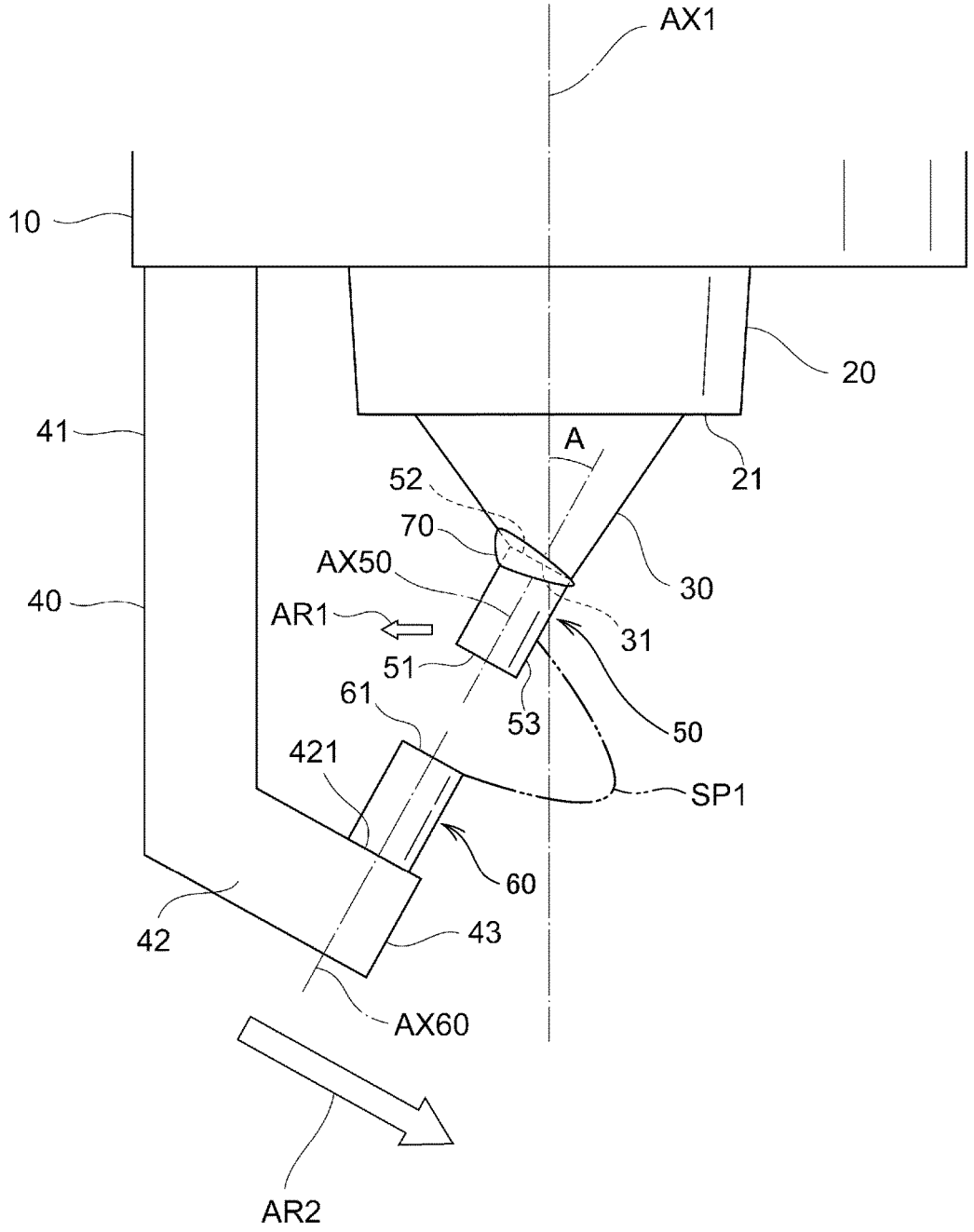
FIG. 2 is an enlarged drawing illustrating a shape of a section where a spark discharge is generated in the spark plug in FIG. 1.
Figure 3:
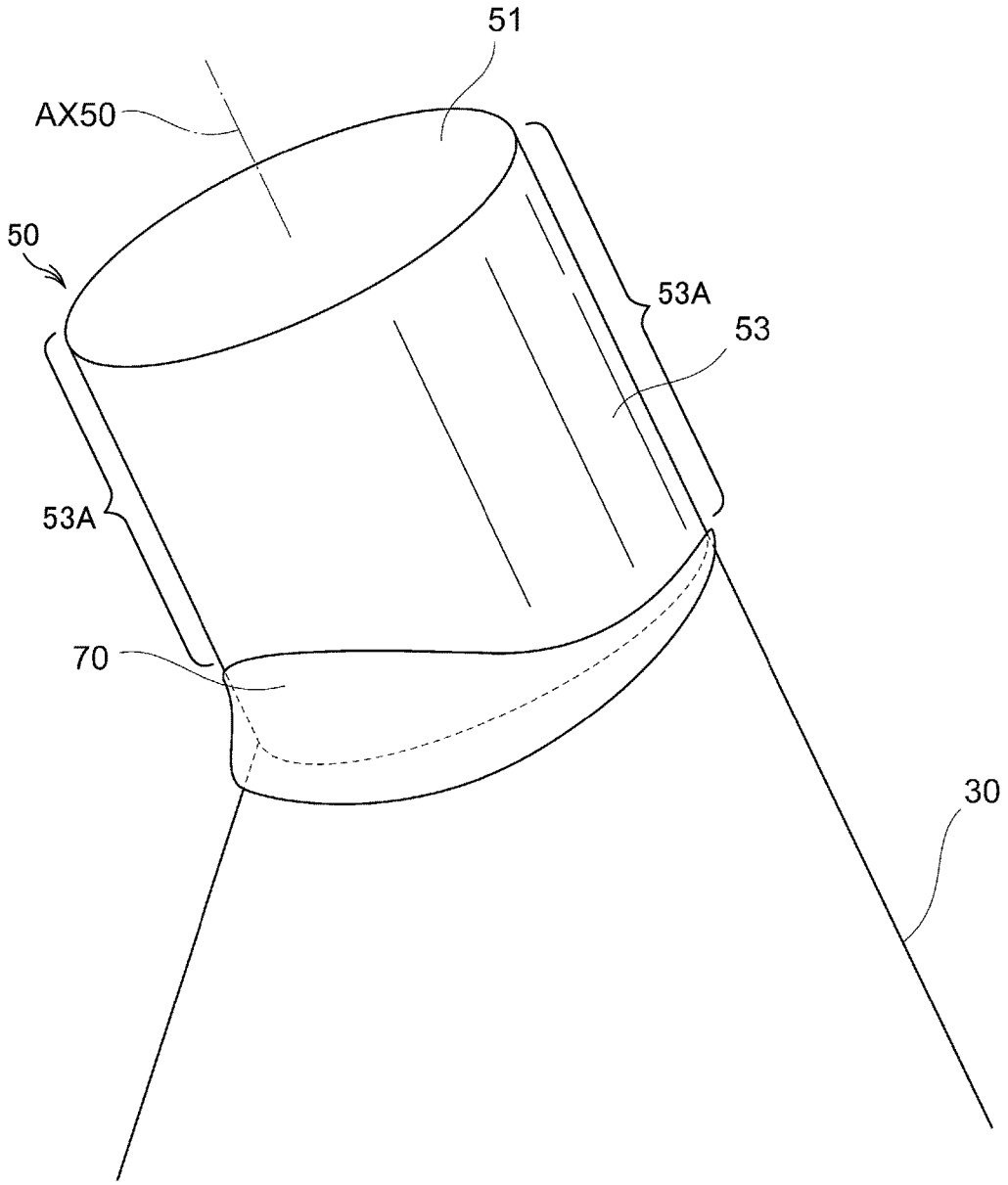
FIG. 3 is a perspective drawing illustrating a shape of a joint section between a center electrode and a center chip.

Referring to the drawings in FIGS. 2 and 3, a shape of a section where the spark discharge is generated is more specifically described. FIG. 2 is an enlarged drawing illustrating respective shapes of the center chip 50 and the ground chip 60 and a section in the vicinity thereof. FIG. 3 is a perspective drawing illustrating a shape of the center chip 50. Additionally, the center chip 50 in FIG. 3 is illustrated in a state where the center chip 50 in FIG. 2 is illustrated upside down.

The shape of the center chip 50 is the same cylindrical shape as that of the ground chip 60. The center chip 50 is welded onto the tip of the center electrode 30 and is fixed thereonto in a state where the center axis AX50 thereof is inclined to the center axis AX1. An inclination angle (A in FIG. 2) of the center axis 50 relative to the center axis AX1 is preferably configured to be within the range from 20 degrees to 70 degrees inclusive.

The center axis AX50 of the center chip 50 is coincident with the center axis AX60 of the ground chip 60. The tip surface 51 of a side of the ground chip 60 in the center chip 50 becomes a surface perpendicular to the center axis AX 50 and faces the tip surface 61 of the ground chip 60 in a parallel state.

A welded section 70 formed by a welding process exists between the center chip 50 and the center electrode 31. The welded section 70 is formed by mixing a material, which is melted during the welding process, of the center chip 50 and a material, which is also melted during the welding process, of the center electrode 30. Respective shapes of the center chip 50 and the center electrode 30 before laser welding are illustrated with dotted lines in FIGS. 2 and 3.

Before the welding process is performed, the flat tip surface 31 is formed on the tip of the center electrode 30. The tip surface 31 becomes a surface parallel to the side surface 421 of the ground electrode 40, and a normal line thereof is parallel to the center axis AX50 and center axis AX60. The tip surface 31 is formed as a surface in order for the normal line thereof to be inclined to the center axis AX1. More specifically, the normal line of the tip surface 31 is inclined toward a side of the ground electrode 40 (a left-side in FIG. 2). The tip surface 31 is a surface where the center chip 50 is provided and welded, and corresponds to a surface to be welded in the exemplary embodiment of the present disclosure.

Before the welding process is performed, an end surface 52 is formed on a section opposite to the tip surface 51 in the center chip 50. The end surface 52 is formed as a round-shape surface perpendicular to the center axis AX50 like the tip surface 51. During the welding process, the welding process is performed by a laser in a state where the end surface 52 of the center chip 50 and the tip surface 31 of the center electrode 30 are mixed with each other. A welding method will be more specifically described later.

The center chip 50 is welded onto the tip surface 31 in a state where the center axis AX50 thereof is perpendicular to the tip surface 31 (the surface to be welded). Consequently, the center chip 50 is provided in a state where the center chip 50 is inclined to the center AX1 of the mounting bracket 10 (a center axis of the center electrode 30).

According to the exemplary embodiment, the center chip 50 is configured to be inclined to the side of the ground electrode 40 (a left side in FIG. 2). A direction toward which the center chip 50 is inclined, that is to say a direction in which the center chip 50 faces toward the side of the ground electrode 40 is hereinafter referred to as an inclination direction of the center chip 50. In FIG. 2, the inclination direction is depicted with an arrow AR1 in the exemplary embodiment.

As depicted in FIG. 2, since the tip 43 of the ground electrode 40 is not extended until a position right above the center electrode 30 (that is, a position where the tip 43 thereof is overlapped with the center axis AX1), a gap between the ground electrode 40 and the center electrode 30 is widely ensured. Accordingly, since a phenomenon in which a flame kernel generated in the vicinity of the center electrode 30 contacts a surface of the ground electrode 40 such that growth of the flame kernel is impeded is able to be prevented, a satisfactory ignitability is able to be performed. Furthermore, the ground electrode 40 is shortened in the aforementioned configuration, thereby to improve an effect of heat dissipation.

In a configuration in which the ground electrode 40 is inclined according to the exemplary embodiment, an airflow inside the combustion chamber is directed along the ground electrode 40 such that the airflow has a tendency to flow in a direction along an arrow AR2 in FIG. 2. A route of the spark discharge generated between the center chip 50 and the ground chip 60 due to an influence of the airflow is depicted with a symbol SP1, that is to say the route thereof becomes bigger with a circular arc shape in a direction toward a right lower side space of the ground electrode 60 in FIG. 2. The aforementioned route is also able to be referred to as a route which becomes bigger with the circular arc shape in a direction away from the ground electrode 40. A space of a direction in which the spark charge becomes bigger is widely ensured by an inclination of the ground electrode 40. For this reason, a comparatively big spark in the exemplary embodiment becomes easy to be formed, thereby improving an ignitability of the spark plug 100.

Furthermore, in the exemplary embodiment, the tip surface 61 of the ground chip 60 and the tip surface 51 of the center chip 50 mutually face each other in a parallel state. For this reason, even though a portion of the ground chip 60, and the like is consumed by a shock of the spark discharge, a distance between the center chip 50 and the ground chip 60, that is to say a discharge distance is not changed but constantly maintained. Consequently, the spark discharge is stably generated such that the ignitability of the spark plug 100 is able to be stably maintained for a long period.

Accordingly, with respect to an initial step in the spark discharge at one time, the spark discharge is generated respectively at a portion of the tip surface 61 of the ground chip 60 and a portion of the tip surface 51 of the center chip 50 as a starting point. In the followings, as depicted in FIG. 2, the starting point of the spark discharge may be moved to side surfaces 53, and the like of the center chip 50 because the route of the spark discharge is changed by airflow influence. There is also a possibility that the starting point of the spark discharge may reach the welded section 70, depending on the airflow state.

Figure 4:
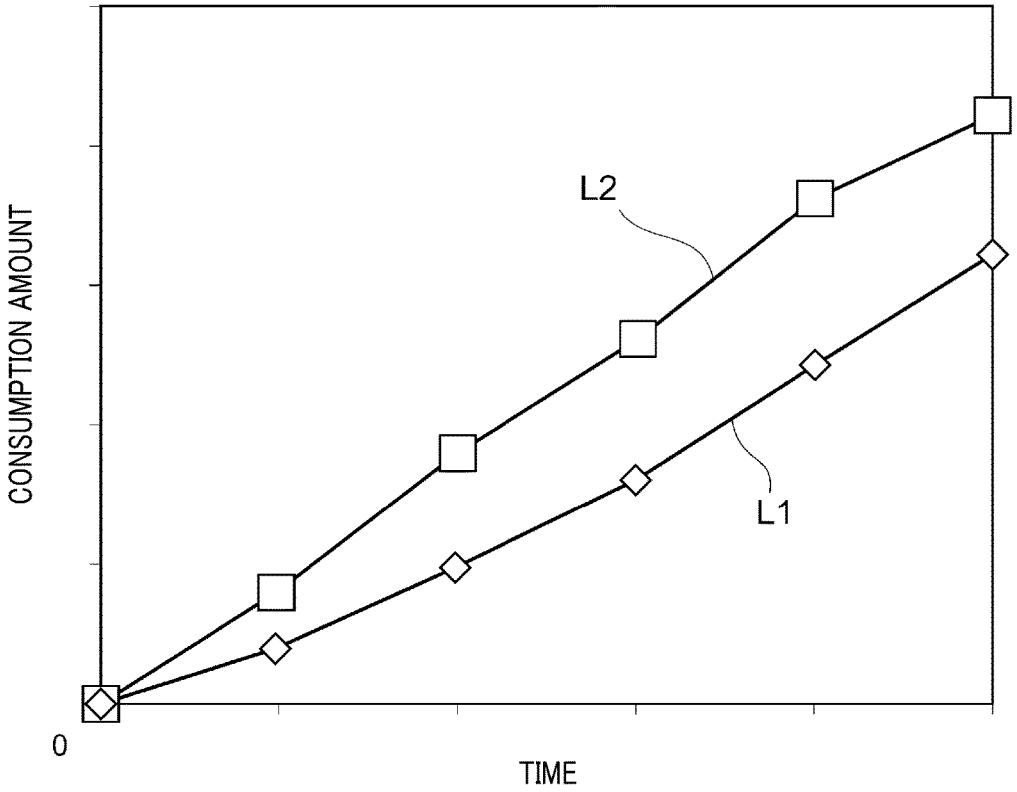
FIG. 4 is a drawing illustrating a change of an electrode consumption amount caused by a spark discharge.

An example of a change of a member consumption amount is depicted while the spark discharge is generated in FIG. 4. When the spark discharge is generated at a portion of the center chip 50 as a starting point, a line L1 depicts a time change of a consumption amount (a consumed volume) of the center chip 50 at the starting point. In addition, when the spark discharge is generated at a portion of the welded section 70 as a starting point, a line L2 depicts a time change of a consumption amount (a consumed volume) of the welded section 70 at the starting point, In more detail, a consumption speed caused by the spark discharge at the welded section 70 becomes comparatively great in comparison with the line L1 and the line L2. For this reason, in order for the whole electrodes formed by the center electrode 30 and the center chip 50 to last for a long period, if possible, it is desirable that the starting point of the spark discharge does not reach the welded section 70 and preferably stops at the tip surface 51 of the center chip 50 and the side surfaces 53 thereof.

Here, the spark plug in the exemplary embodiment is configured for the starting point of the spark discharge to hardly reach up to the welded section 70 by contemplating a shape of the welded section 70.

Figure 5:
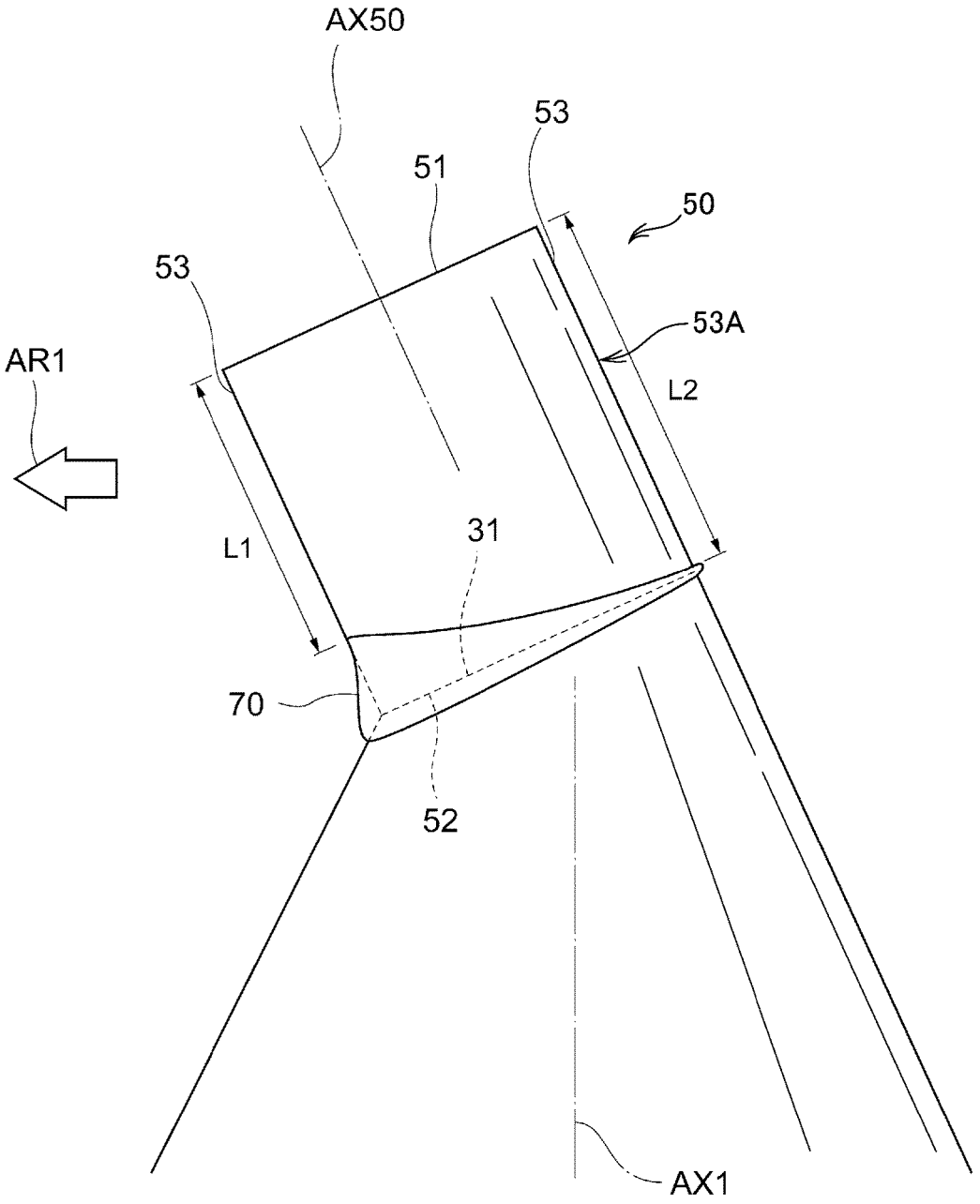
FIG. 5 is a lateral view illustrating a shape of a joint section between a center electrode and a center chip.

When viewed in a direction perpendicular to a surface including both the center axis AX50 of the center chip 50 and the center axis AX1 of the mounting bracket 10, the center chip 50 and a configuration in the vicinity thereof are depicted in FIG. 5. An inclination direction of the center chip 50 is depicted with the arrow AR1 in FIG. 5. As depicted in FIG. 5, a section of an inclination direction side in the welded section 70, that is to say a left side section in FIG. 5, is more thickly formed than a section opposite to the inclination direction side of the welded section 70, that is to say a right side section in FIG. 5.

Hereinafter, a section except the welded section 70 formed by being welded onto the tip surface 31 is referred to as an unwelded section in the side surfaces 53 of the center chip 50. Furthermore, a length of the unwelded section along the center axis AX50 of the center chip 50 is referred to as an unwelded section length. The unwelded section length defined as above corresponds to a distance from the tip surface 51, which is an initial starting point of the spark discharge, to the welded section 70. Thus, in order for the starting point of the spark discharge not to reach up to the welded section 70, it is desirable that the unwelded section length is configured to be long.

In the exemplary embodiment, the welded section 70 is formed as described above such that the unwelded section length is not same as whole side surfaces and is configured to be changed depending on a position along the circumferential direction CR of the center chip 50. More specifically, the unwelded section length becomes shortest in a section most adjacent to the ground electrode 40 in the side surfaces 53, that is to say a section of a most inclined direction side (a left side in FIG. 5) in the side surfaces 53, and this unwelded section length is depicted as L1 in FIG. 5. In addition, the unwelded section length becomes longest in a section most far away from the ground electrode 40 in the side surfaces 53, that is to say a section opposite to the most inclined direction side (a right side in FIG. 5) and this unwelded section length is depicted as L2 in FIG. 5.

Figure 6:
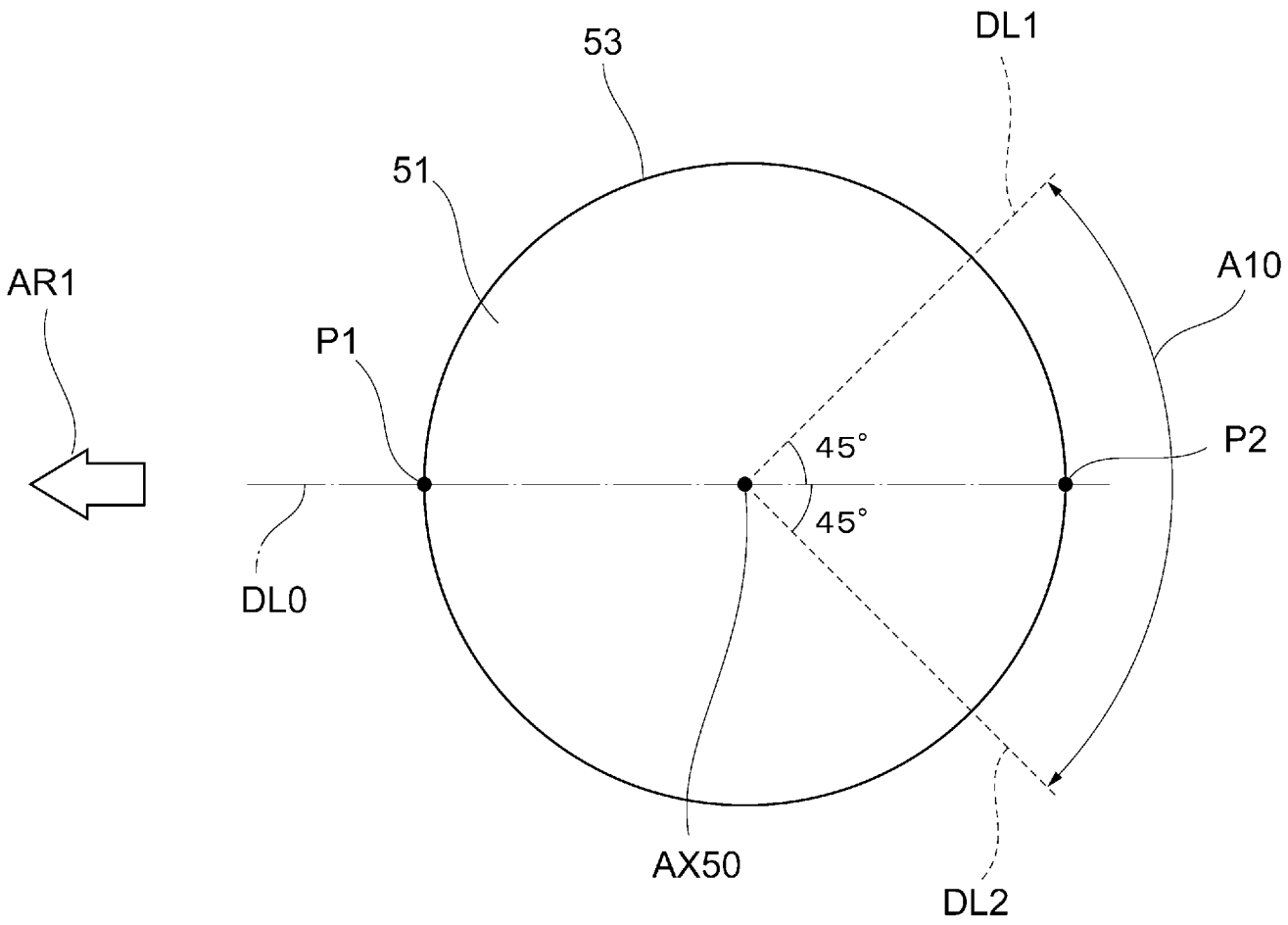
FIG. 6 is a drawing illustrating a range which easily becomes a starting point of a spark discharge in a center chip.

When viewed along the center axis AX50, the center chip 50 is depicted in FIG. 6. The inclination direction of the center chip 50 is also depicted with the arrow AR1 in FIG. 6. That is, the ground electrode 40 (not depicted) exists in a position, a left side of the center chip 50, in FIG. 6.

A section most adjacent to the ground electrode 40 in the side surfaces 53 (actually a linear section parallel to the center axis AX 50) is depicted as a point P1 in FIG. 6. Furthermore, a section most far away from the ground electrode 40 in the side surfaces 53 (also, the linear section parallel to the center axis AX 50) is depicted as a point P2 in FIG. 6. The point P1 is a section to become L1 where the unwelded section length is shortest, and the point P2 is a section to become L2 where the unwelded section length is longest.

A straight line tying the point P1 and the point P2 is depicted as a dotted line DL0 in FIG. 6. Additionally, a straight line passing through the center axis AX50 (a center of the tip surface 51 in FIG. 6) and having an angle of 45 degrees with respect to the dotted line DL0 is depicted as a dotted line DL1 and a dotted line DL2. A range A10 from the dotted line DL1 to the dotted line DL2 in the side surfaces 53 becomes an angle of 90 degrees centered upon a section (a point P2) most far away from the ground electrode 40 in the circumferential direction CR of the center chip 50.

As described above with reference to FIG. 2, with respect to the spark plug based on a configuration in which the portion of the ground electrode 40 in the exemplary embodiment is inclined, a route SP1 of the spark discharge has a tendency to become a circular arc shape to be bigger in a direction away from the ground electrode 40. Thus, the starting point of the spark discharge in the side surfaces of the center chip 50 can easily be concentrated on a section opposite to the inclination direction. According to exemplary embodiments of the present disclosure, a position within a range A10 of 90 degrees depicted in FIG. 6 has a 74% probability to become the starting point of the spark discharge, whereas a position within a range of 90 degrees centered upon a section (the point P1) most adjacent to the ground electrode 40 in the circumferential direction CR of the center chip 50 has only 1% probability to become the starting point of the spark discharge.

According to the exemplary embodiment, as described above, the welded section 70 is formed in order for the unwelded section length L2 in a section which easily becomes the starting point of the spark discharge to become longer than the unwelded section length L1 in a section which is difficult to become the starting point of the spark discharge. That is, the welded section 70 is formed in order for the unwelded section length L2 in a section far away from the ground electrode 40 to become longer than the unwelded section length L1 in a section adjacent to the ground electrode 40.

Consequently, since the starting point of the spark discharge is configured to avoid the welded section 70, dramatic consumption of the welded section 70 is able to be prevented. Furthermore, for example, as a configuration in which the spark discharge does not reach up to the welded section 70, it may be contemplated that a length of the center chip 50 is designed long enough. However, the aforementioned configuration is not desirable because a consumption amount of an expensive noble metal material becomes great. According to the exemplary embodiment, a probability that the starting point of the spark discharge reaches up to the welded section 70 is low by designing a length of the center chip 50 not long and by contemplating a shape of the welded section 70.

Furthermore, a section where the unwelded section length becomes longest may not only be formed at a section (the point P2) most far away from the ground electrode 40 according to the exemplary embodiment, but also may be formed at a section different from the point P2. In this case, it is desirable that the section where the unwelded section length becomes longest is formed within the range A10 of 90 degrees centered upon a section (the point P2) most far away from the ground electrode 40.

A method of manufacturing the spark plug 100 based on the above-mentioned configuration will now be described. More specifically, with respect to the method of manufacturing the spark plug 100, a preparation process, an installation process, and a welding process are hereinafter described.

<Preparation Process>

In the preparation process, the center chip 50 and the center electrode 30, which are objects to be welded, are respectively prepared. As described above, the center chip 50 is formed to have a cylindrical shape, and both the tip surface 51 of the center chip 50 and the end surface 52 thereof are respectively formed as surfaces perpendicular to the center axis AX50. In addition, the tip surface 31 of the center electrode 30 is formed as a surface inclined relative to the center axis of the center electrode 30.

<Installation Process>

Figure 7:
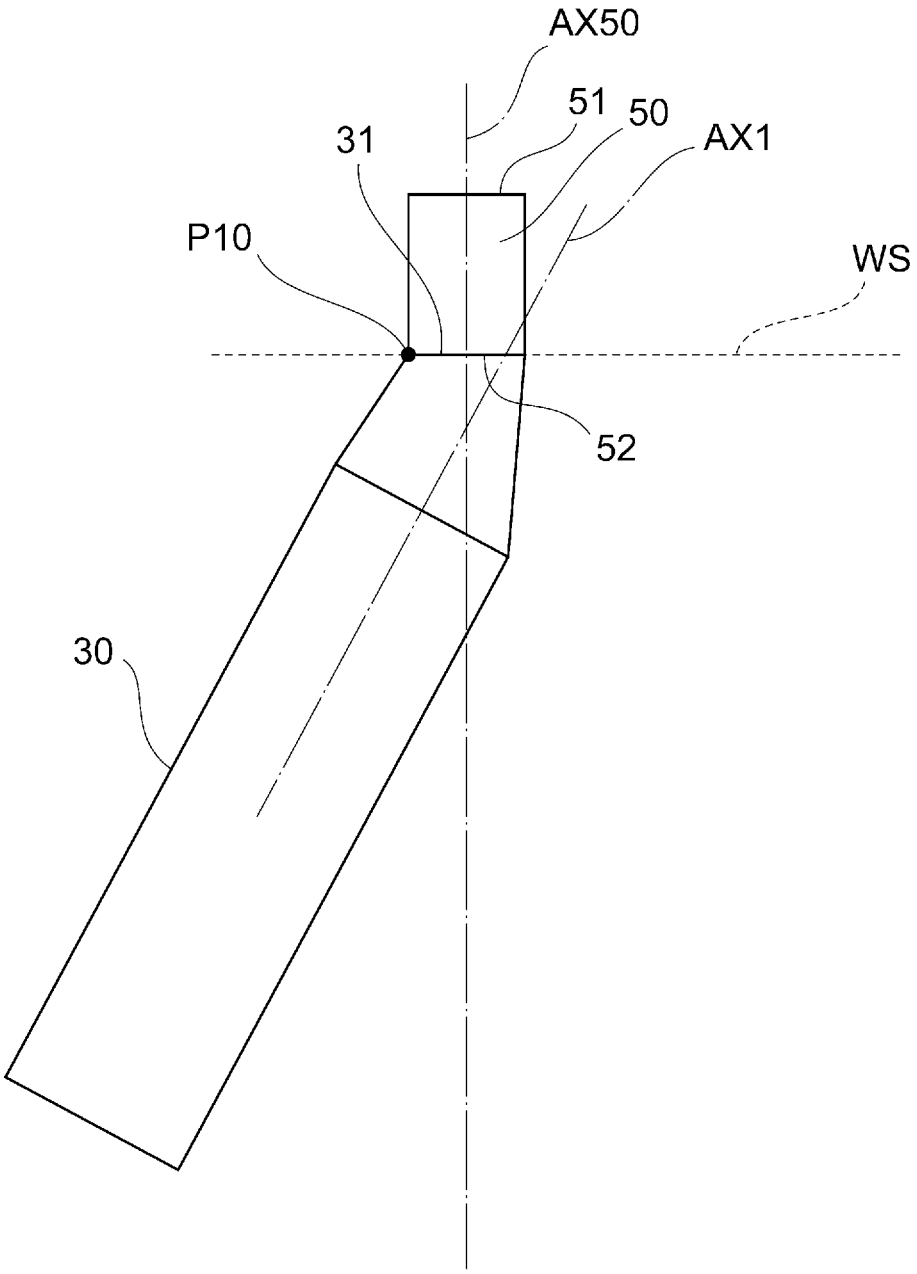
FIG. 7 is a drawing illustrating a method of welding a center chip onto a center electrode.

In the installation process continuously performed after the preparation process, the center chip 50 is provided on the tip surface 31 in order for the center axis AX50 of the center chip 50 to be perpendicular to the tip surface 31 (the surface to be welded) of the center electrode 30. A state of the center chip 50 and the center electrode 30 at a time when the installation process is completed is depicted in FIG. 7. At this time, the center axis AX50 of the center chip 50 becomes perpendicular to a horizontal surface WS. When the installation process is completed, the center chip 50 and the center electrode 30 are mounted on a work holding section of a laser welding machine (not depicted) under a state depicted in FIG. 7. At this time, the work holding section holds a portion of the center electrode 30 under a state where the tip surface 31 of the center electrode 30 is configured to be parallel to the horizontal surface WS.

Furthermore, a point P10 depicted in FIG. 7 and FIG. 8 (to be described later) is an edge section of the end surface 52 of the center chip 50 and becomes the most inclined direction side in the sections. The point P10 is the section most adjacent to the earth electrode 40 in a state where the center electrode 30 is held at the inside of the mounting bracket 10. In addition, the point P10 is also able to be referred to as a point depicting an end section which becomes a side of the center electrode 30 the most in a section (which is actually a linear section) depicted with the point P1 in FIG. 6.

<Welding Process>

A laser is irradiated between the center chip 50 and the tip portion surface 31 such that the center chip 50 is laser-welded onto the tip surface 31 in the welding process continuously performed after the installation process. FIG. 8 is a drawing schematically illustrating a state when the welding process is performed according to the exemplary embodiment.

In the welding process, both the center chip 50 and the center electrode 30 are rotated around the center axis AX50 as depicted with an arrow RT. The aforementioned rotation is accomplished by a rotation of the work holding section provided with the laser welding machine. A laser irradiation direction in the exemplary embodiment is in a direction perpendicular to the center axis AX50, and is in a direction specifically fixed toward the center axis AX50. That is, the laser irradiation direction in the exemplary embodiment is configured to become constant.

Figure 8:
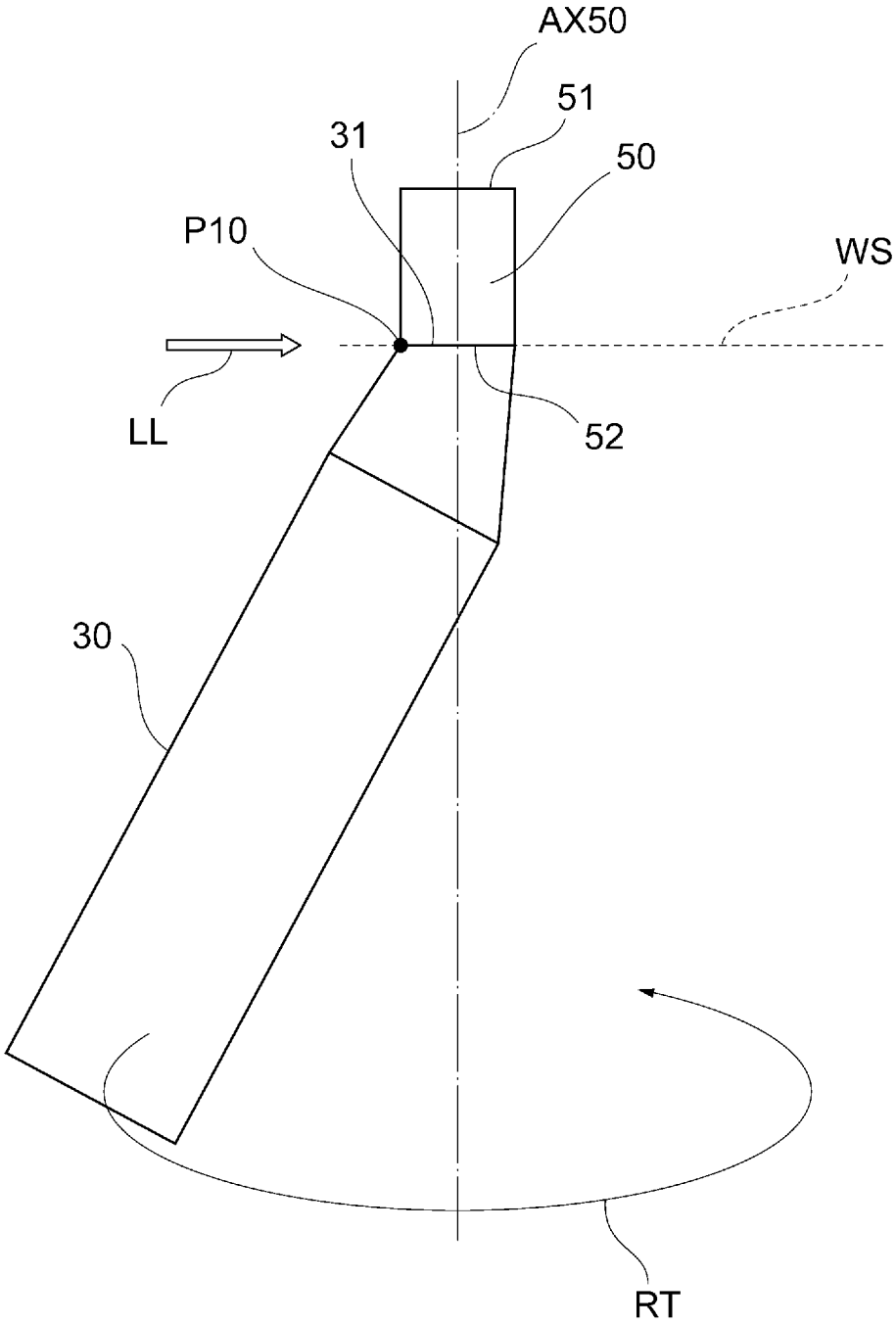
FIG. 8 is a drawing illustrating a method of welding a center chip onto a center electrode.

As described above, the laser irradiation direction is depicted with an arrow LL in FIG. 8. After the laser irradiation direction is fixed, both the center chip 50 and the center electrode 30 are rotated such that a position at which a laser is irradiated in a boundary section between the center chip 50 and the center electrode 30 is (relatively) moved along the circumferential direction CR in FIG. 8.

Figure 9:
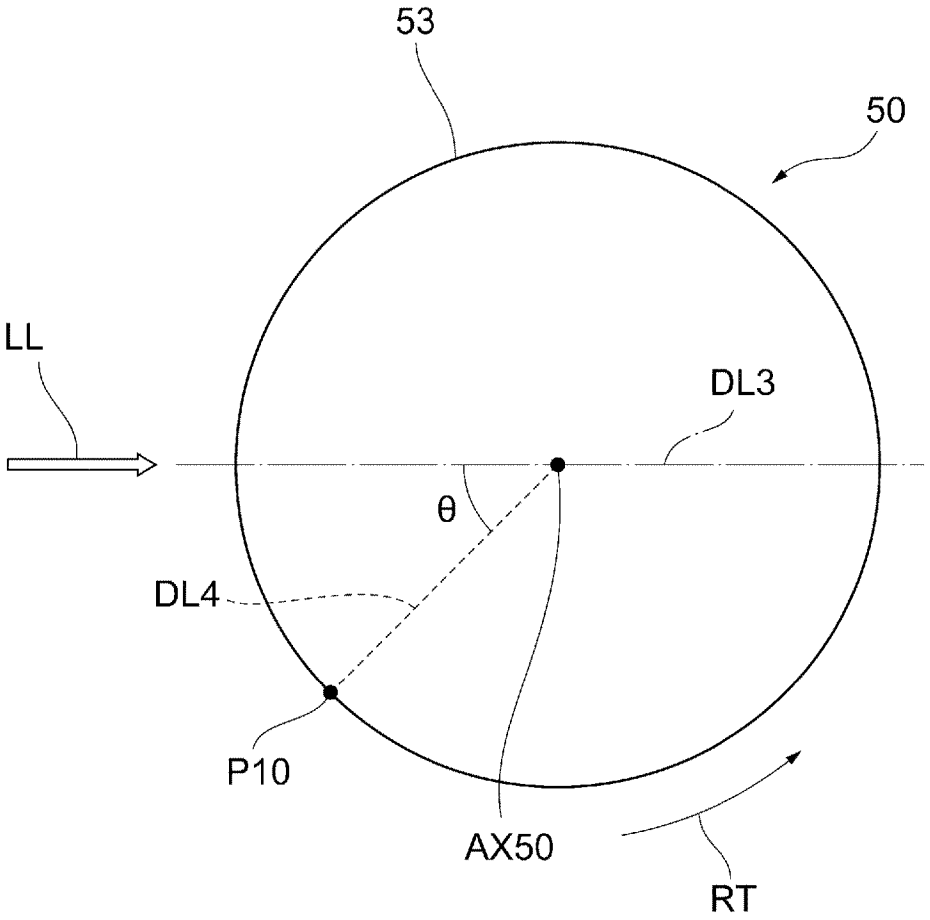
FIG. 9 is a drawing illustrating a change of a laser irradiation position during a welding process.

The point P10 depicted in FIG. 9 is the same point as the point P10 described with reference to FIG. 8. An angle configured between a dotted line DL 3 depicting the laser irradiation direction (which is also referred to as an irradiation route) and a dotted line DL4 configured by connecting the center axis AX 50 and the point P10 is hereinafter referred to as a rotation angle θ of the center electrode 30 and the center chip 50 in FIG. 9. In the welding process, a section in the vicinity of the end surface 52 in the center chip 50 is laser-welded along the entire circumference by an increase of the rotation angle θ performed by rotating the center electrode 30, and the like, and by performing the laser irradiation repeatedly.

More specifically, whenever the rotation angle θ is increased to only 30 degrees, rotation of the center electrode 30, and the like, is temporarily stopped, and the laser irradiation is performed only for a predetermined time in the aforementioned state. When the laser irradiation is stopped, a process in which the rotation angle θ is increased to only 30 degrees is performed, and the laser irradiation is performed in a state where the rotation of the center electrode 30, and the like, is stopped. After that, the same process is repeatedly performed.

Figure 10:
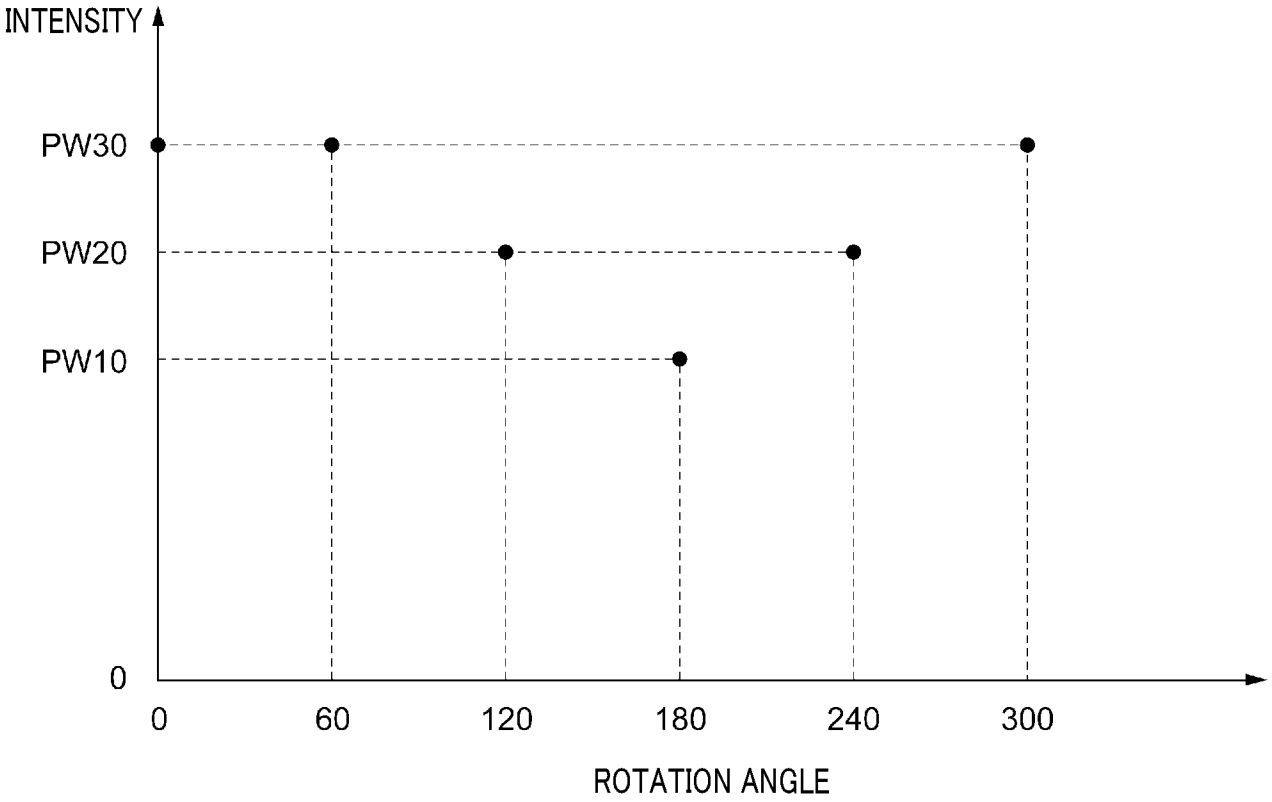
FIG. 10 is a drawing illustrating laser irradiation intensity during a welding process.

According to the exemplary embodiment of the present disclosure, a laser irradiation intensity is not always fixed, but is controlled to be changed depending a change of the rotation angle θ. A relationship between the rotation angle θ and the laser irradiation intensity is depicted in FIG. 10. As described in FIG. 10, when the rotation angle θ is 0 degree, that is, when a laser is irradiated at the point P10, which is a section of an inclination direction side of the center chip 50, in a boundary section between the center chip 50 and the center electrode 30, the laser irradiation intensity becomes a greatest value P30. For this reason, a comparatively thick welded section 70 at the point P1 and in the vicinity thereof is formed, and thus consequently the unwelded section length becomes short. After that, the laser irradiation intensity is adjusted to be low according to the increase of the rotation angle θ.

According to the exemplary embodiment, when the rotation angle θ is 0 degrees and 60 degrees, the laser irradiation intensity becomes a value PW30. Furthermore, when the rotation angle θ is 120 degrees, the laser irradiation intensity becomes a value PW20 lower than the value PW30. In addition, when the rotation angle θ is 180 degrees, the laser irradiation intensity value becomes a lowest value PW10. As the laser irradiation intensity becomes gradually lower and lower, the thickness of the welded section 70 formed at respectively irradiated portions becomes gradually thinner and thinner. When the laser is irradiated at a point opposite to the inclination direction of the center chip 50 in a boundary section between the center chip 50 and the center electrode 30 (that is, when the rotation angle θ is 180 degrees), a comparatively thin welded section 70 is formed at the point, and thus consequently the unwelded section length becomes long.

When the rotation angle θ is greater than 180 degrees, the laser irradiation intensity is adjusted to become larger according to the increase of the rotation angle θ. In the exemplary embodiment, when the rotation angle θ is 240 degrees, the laser irradiation intensity value becomes the value PW20. Furthermore, when the rotation angle θ is 300 degrees, the laser irradiation intensity value becomes the initial value PW30.

As described above, both the center chip 50 and the center electrode 30 are rotated around the center axis AX50, and further the laser irradiation is performed from a fixed direction in the welding process. Additionally, the laser irradiation intensity is changed according to the change of the rotation angle θ of the center chip 50 and the center electrode 30. Accordingly, the thickness of the welded section 70 is changed along the circumferential direction CR, and thus consequently the unwelded section length at a side opposite to the inclination direction side is able to become longest.

Furthermore, according to a variation of the exemplary embodiment, the laser irradiation intensity may not be changed, whereas an irradiation time may be changed. For example, regardless of the rotation angle θ, the laser irradiation intensity may be constant, after which the laser irradiation time may be longest when the rotation angle θ is 0 degree, and the laser irradiation time may be shortest when the rotation angle θ is 180 degrees. In other words, when the laser is irradiated at the section of the inclination direction side of the center chip 50, the laser irradiation time may be longer, and when the laser is irradiated at the section opposite to the inclination direction side of the center chip 50, the laser irradiation time may be shorter. In the variation of the exemplary embodiment, the unwelded section length at the side opposite to the inclination direction side may be also longest.

Furthermore, only one of the irradiation intensity and the irradiation time may not only be changed, but also both thereof may be respectively changed as described above.

A variation of the welding process will be described with reference to FIG. 11. In this variation, the welding process between the center chip 50 and the center electrode 30 is performed by irradiating the laser only from the inclination direction side of the center chip 50 in a state where the center chip 50 and the center electrode 30 are not rotated but are stationary.

Figure 11:
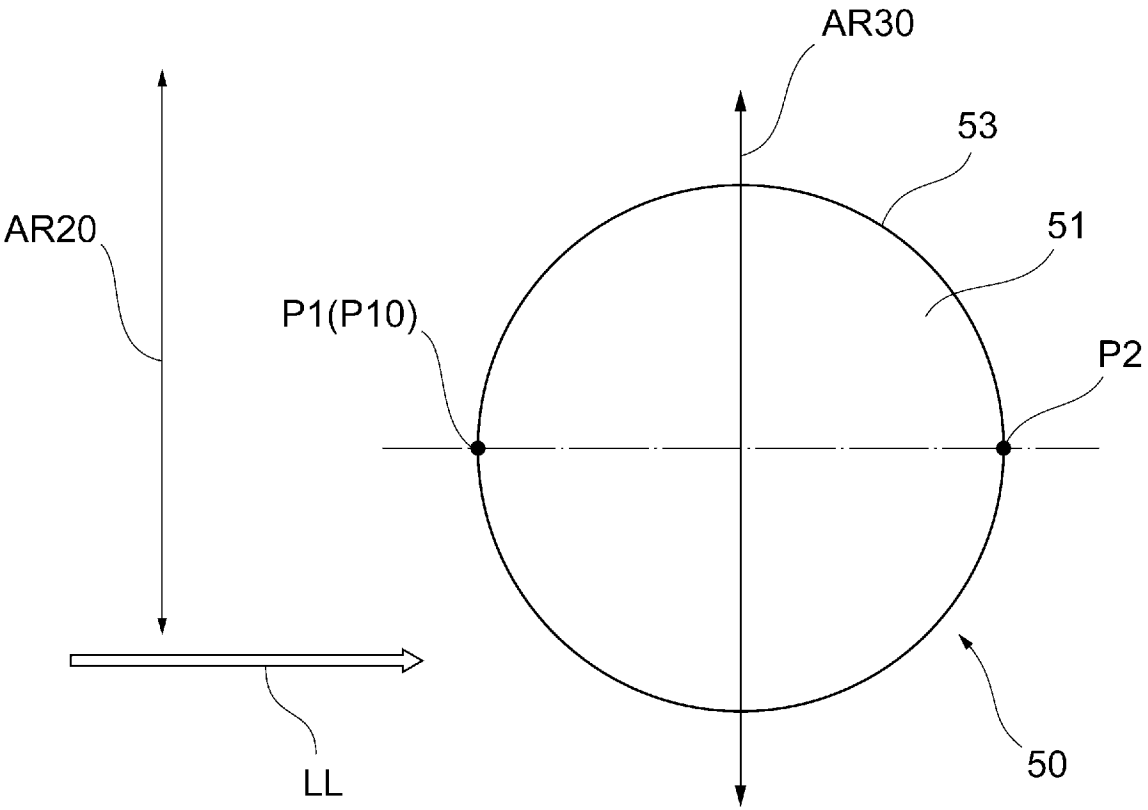
FIG. 11 is a drawing illustrating a variation of a method of welding a center chip onto a center electrode.

As depicted in FIG. 11, the laser irradiation position is reciprocated in a direction (an arrow AR20) perpendicular to the laser irradiation direction (an arrow LL) in the welding process of the variation. A width of an orbit while the irradiation position is reciprocated is slightly larger than a diameter of the center chip 50. Furthermore, with respect to a position to be a center of an orbit along which the irradiation position is reciprocated, the laser is irradiated at the point P10.

As described above, when the welding process is performed, the welded section 70 is formed to be thick at a section of the inclination direction side at which the laser is irradiated, and thus consequently the unwelded section length becomes short. Additionally, the welded section 70 is formed to be thin at a section of a side opposite to the inclination direction, and thus consequently the unwelded section length becomes long.

Furthermore, in order for the laser irradiation to be changed as described above, the laser may not only be performed based on reciprocating motion, but also the center chip 50 and the center electrode 30 may move in the reciprocating motion in a state where the laser is stationary. Activation while the center chip 50, and the like move in the reciprocating motion is depicted with an arrow AR30 in FIG. 11.

The center chip 50 and a cross-sectional drawing in the vicinity thereof are depicted at a time when the welding process is completed in FIG. 12. Respective cross-sectional drawings are depicted in a case that the center chip 50, and the like are cut off at a surface including both the center axis AX50 and the center axis AX1.

Figure 12A:
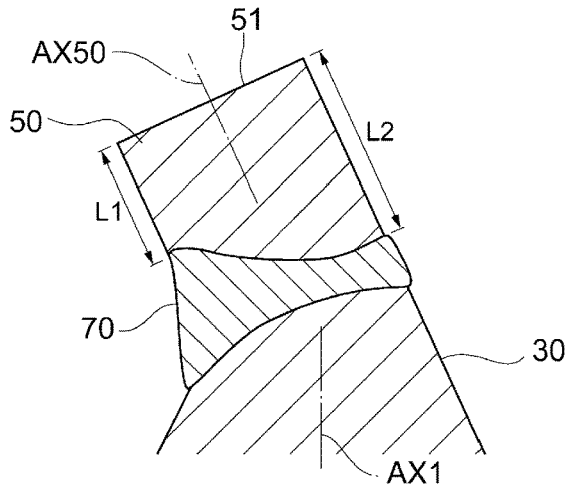
FIGS. 12A to 12C are cross-sectional drawings each illustrating a state of a welded section.

A cross section is depicted in a case that the welding process is performed while the center chip 50, and the like are rotated according to the above-mentioned exemplary embodiment in FIG. 12A. In an example of FIG. 12A, the welded section 70 is formed along entire sections between the center chip 50 and the center electrode 30.

Furthermore, the welded section 70 of an inclination direction side (a left side in FIG. 12A) is formed to be thick such that the unwelded section length L2 opposite to the unwelded section length L1 becomes longer than the unwelded section length L1 of the inclination direction side.

Figure 12B:
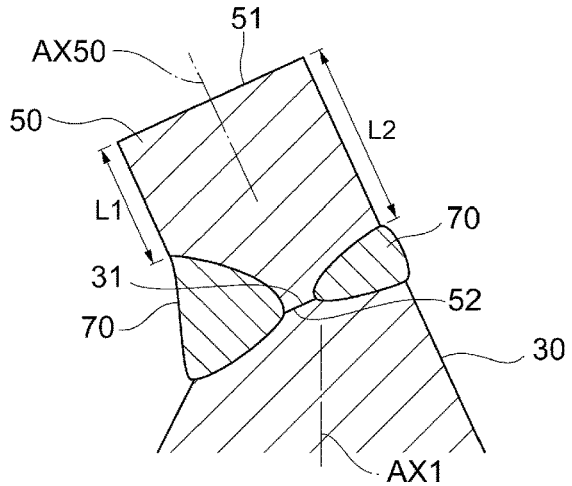

In addition, the welded section 70 not only may be formed along entire sections between the center chip 50 and the center electrode 30, but also may not be formed at a portion of the inside of the center chip 50 and the center electrode 30. That is, as depicted in FIG. 12B, while the welded section 70 is formed at an outer circumferential side section of the center chip 50, and the like, the end surface 52 and the tip surface 31 at the portion of the inside thereof also may remain exist.

Figure 12C:
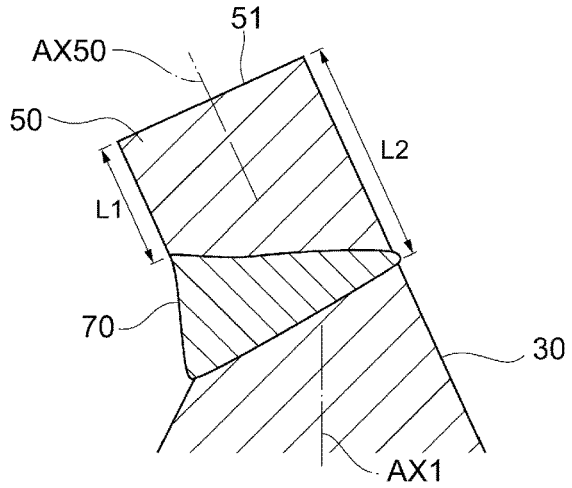

A cross section is depicted in a case that the laser is irradiated only from the inclination direction side according to the above-mentioned variation in FIG. 12C. In this case, as the welded section 70 is moved from the inclination direction side (a left side) to a side opposite thereto (a right side), the welded section 70 becomes gradually formed to be thin. Also, in the case of an example of FIG. 12C, the unwelded section length L2 at the side opposite to the inclination direction side is able to be designed long like the examples of the FIG. 12A, and the like.

Furthermore, after the welding process is performed, a process where the center electrode 30 of which the welding process is completed is inserted into the inside of the mounting bracket 10, a process where an inclination angle of the ground electrode 40 is adjusted, and the like are performed. Here, since any one of the processes is able to adopt heretofore known methods, the descriptions thereof are omitted.

In the exemplary embodiments, the shapes of the center chip 30 and the ground chip 60 are described based on the cylindrical shape, but the shapes of the center chip 30, and the like are not limited to the cylindrical shape. For example, in a case that the center chip 30, and the like based on a quadrangular cylindrical shape and a hexagonal cylindrical shape are adopted, the same effects as the aforementioned descriptions are obtained.

As described above, the exemplary embodiments of the present disclosure are described with reference to the specific examples. However, it is understood that the present disclosure is not limited to the disclosed specific embodiments. That is, modifications with respect to such specific embodiments preferably designed by those skilled in the art are also intended to cover the scope of the present disclosure as long as they include characteristics of the present disclosure. For example, respective elements provided in the previously mentioned specific embodiments and arrangements, materials, conditions, shapes, and sizes thereof are not limited to the exemplary embodiments set forth above, but are able to be appropriately modified. Furthermore, respective elements provided in the previously mentioned respective exemplary embodiments are able to be combined with each other as long as technically possible, and combinations thereof are also included in the scope of the present disclosure as long as they include the characteristics of the present disclosure.

DESCRIPTION OF THE REFERENCE NUMERALS

100: Spark Plug
10: Mounting Bracket
30: Center electrode
31: Tip Surface
40: Ground Electrode
50: Center Chip
53A: Unwelded section
60: Ground Chip
70: Welded section
AX1: Center Axis
AX50: Center Axis

What is claimed is:

1. A spark plug for an internal-combustion engine, comprising:

a cylindrical mounting bracket;

a ground electrode configured for one end side to be fixed to the mounting bracket, and configured for at least a portion of the other end side to be inclined to a center axis of the mounting bracket in order to come close to the center axis thereof as moving to the other end side;

a ground chip provided to protrude from a portion of the ground electrode;

a center electrode configured to be disposed along the center axis of the mounting bracket, and configured for a normal line of a surface to be welded, which is an end surface of the center electrode, to be inclined toward a side of the ground electrode; and a center chip configured to be welded on the surface to be welded in a state where a center axis of the center chip is perpendicular to the surface to be welded, and configured to be provided in a state where the center chip is inclined to a center axis of the center electrode, wherein when a section except a welded section formed by welding the surface to be welded is defined as an unwelded section in side surfaces of the center chip, and a length of an unwelded section along the center axis of the center chip is defined as an unwelded section length, the welded section is formed in order for an unwelded section length in a side surface opposite to an inclination direction side of the center chip in the center chip to become longer than an unwelded section length in a side surface of the inclination direction side of the center chip in the center chip.

2. The spark plug according to claim 1, wherein a section where the unwelded section length is longest in the side surfaces of the center chip is positioned within a range of 90 degrees centered upon a section most far away from the ground electrode in a circumferential direction of the center chip.

3. The spark plug according to claim 2, wherein the section where the unwelded section length is longest in the side surfaces of the center chip is positioned in the section most far away from the ground electrode in the circumferential direction of the center chip.

4. A method of manufacturing a spark plug, comprising:

a cylindrical mounting bracket;

a ground electrode configured for one end side to be fixed to the mounting bracket, and configured for at least a portion of the other end side to be inclined to a center axis of the mounting bracket in order to come close to the center axis thereof as moving to the other end side;

a ground chip provided to protrude from a portion of the ground electrode;

a center electrode configured to be disposed along the center axis of the mounting bracket, and configured for a normal line of a surface to be welded, which is an end surface of the center electrode, to be inclined toward a side of the ground electrode; and a center chip configured to be welded on the surface to be welded in a state where a center axis of the center chip is perpendicular to the surface to be welded, and configured to be provided in a state where the center chip is inclined to a center axis of the center electrode, wherein when a section except a welded section formed by welding the surface to be welded is defined as an unwelded section in side surfaces of the center chip, and a length of an unwelded section along the center axis of the center chip is defined as an unwelded section length, and the welded section is formed in order for an unwelded section length in a side surface opposite to an inclination direction side of the center chip in the center chip to become longer than an unwelded section length in a side surface of the inclination direction side of the center chip in the center chip, the method of manufacturing the spark plug, comprising:

a preparation process of preparing the center electrode and the center chip respectively;

an installation process of installing the center chip on the surface to be welded in order for the center axis of the center chip to be perpendicular to the surface to be welded; and a welding process of irradiating a laser between the center chip and the surface to be welded, and to weld the center chip onto the surface to be welded.

5. The method of manufacturing the spark plug according to claim 4, wherein the welding process is configured to rotate both the center chip and the center electrode, and to perform a laser irradiation in a fixed-direction around the center axis of the center chip; and at least any one of both a laser irradiation intensity and a irradiation time is configured to be changed in accordance with a rotation angle change of the center chip and the center electrode.

6. The method of manufacturing the spark plug according to claim 5, wherein when a laser is irradiated on a section of the inclination direction side of the center chip, at least any one value of both the laser irradiation intensity and the irradiation time becomes great in the welding process; and when the laser is irradiated on a section opposite to the inclination direction side of the center chip, at least any one value of both the laser irradiation intensity and the irradiation time becomes small in the welding process.

7. The method of manufacturing the spark plug according to claim 4, wherein the laser irradiation is performed only from the inclination direction side of the center chip in the welding process.

* * * * *